US011253850B2

(12) United States Patent
Smith et al.

(10) Patent No.: US 11,253,850 B2
(45) Date of Patent: Feb. 22, 2022

(54) PIPETTE DISPENSER TIP UTILIZING PRINT HEAD

(71) Applicant: HEWLETT-PACKARD DEVELOPMENT COMPANY, L.P., Houston, TX (US)

(72) Inventors: Matthew David Smith, Corvallis, OR (US); Christie Dudenhoefer, Corvallis, OR (US); Jeffrey A. Nielsen, Corvallis, OR (US); Kenneth Ward, Corvallis, OR (US); Hilary Ely, Corvallis, OR (US)

(73) Assignee: Hewlett-Packard Development Company, L.P., Spring, TX (US)

( * ) Notice: Subject to any disclaimer, the term of this patent is extended or adjusted under 35 U.S.C. 154(b) by 404 days.

(21) Appl. No.: 16/099,460

(22) PCT Filed: Jul. 14, 2016

(86) PCT No.: PCT/US2016/042274
§ 371 (c)(1),
(2) Date: Nov. 7, 2018

(87) PCT Pub. No.: WO2018/013120
PCT Pub. Date: Jan. 18, 2018

(65) Prior Publication Data

US 2019/0168207 A1 Jun. 6, 2019

(51) Int. Cl.
*B01L 3/02* (2006.01)
*B41J 2/14* (2006.01)

(52) U.S. Cl.
CPC ..... *B01L 3/0237* (2013.01); *B01L 3/02* (2013.01); *B01L 3/0268* (2013.01); *B01L 3/0275* (2013.01); *B41J 2/1404* (2013.01); *B01L 2200/0605* (2013.01); *B01L 2300/027* (2013.01); *B41J 2202/12* (2013.01)

(58) Field of Classification Search
None
See application file for complete search history.

(56) References Cited

U.S. PATENT DOCUMENTS

| | | | |
|---|---|---|---|
| 6,352,338 | B1 | 3/2002 | Komuro |
| 7,819,030 | B2 | 10/2010 | Magnussen et al. |
| 7,935,317 | B2 | 5/2011 | Axtell et al. |
| 7,976,793 | B2 | 7/2011 | Solotareff et al. |
| 8,122,779 | B2 | 2/2012 | Nelson et al. |
| 8,211,383 | B2 | 7/2012 | Nielsen et al. |
| 8,871,157 | B2 | 10/2014 | Homber et al. |
| 9,156,031 | B2 | 10/2015 | Gruner et al. |
| 9,321,048 | B2 | 4/2016 | Mettier et al. |

(Continued)

FOREIGN PATENT DOCUMENTS

| | | |
|---|---|---|
| WO | WO-1998010265 | 3/1998 |
| WO | WO-2005052781 | 6/2005 |

*Primary Examiner* — Kathryn Wright
(74) *Attorney, Agent, or Firm* — Dicke Billig & Czaja PLLC

(57) ABSTRACT

An apparatus includes a pipette dispenser to control dispensing of a volume to a dispensing location. A tip is operatively coupled to the pipette dispenser. The tip includes an electromechanical print head to dispense the volume from the pipette dispenser to the dispensing location based on a command from the pipette dispenser that indicates an amount of the volume to be dispensed from the print head.

18 Claims, 4 Drawing Sheets

(56) References Cited

U.S. PATENT DOCUMENTS

| | | | | |
|---|---|---|---|---|
| 2008/0259148 | A1* | 10/2008 | Nielsen | B41J 3/46 347/109 |
| 2009/0047440 | A1* | 2/2009 | Giri | G01N 35/1016 427/457 |
| 2012/0046883 | A1 | 2/2012 | Ayliffe et al. | |
| 2014/0247309 | A1 | 9/2014 | Reinten et al. | |
| 2015/0004078 | A1 | 1/2015 | Baron | |

* cited by examiner

PIPETTE DISPENSER TIP UTILIZING PRINT HEAD

BACKGROUND

A pipette is a laboratory tool commonly used in chemistry, biology and medicine to transport a measured volume of liquid, often as a fluid dispenser. Pipettes come in several designs for various purposes with differing levels of accuracy and precision, from single piece glass pipettes to more complex adjustable or electronic pipettes. Many pipette types operate by creating a partial vacuum above the liquid-holding chamber and selectively releasing this vacuum to draw up and dispense liquid, for example. Measurement accuracy varies depending on the style of pipette employed.

DETAILED DESCRIPTION

This disclosure relates to a pipette dispenser that utilizes an electromechanical print head to dispense a volume from a tip associated with the pipette dispenser. In contrast to conventional pipette tip dispensing, the print head when utilized as the final dispensing element on the pipette tip can dispense smaller volumes than the volume amount that can be dispensed from a conventional pipette dispenser/tip that in general is no less than 2.0 micro liters, for example. By utilizing the print head as the control mechanism to control flow from the pipette tip in controlled and precise amounts, volume levels to be dispensed can be controlled to about 0.1 nano liters, for example. The ability to accurately measure, mix, and dispense small fluid volumes is an important function in clinical and research laboratory settings. Hand-held pipettes are fundamental tools used to manipulate small fluid volumes for molecular biology, immunoassays, molecular diagnostics, drug discovery, cancer research, and many other life science applications, for example. However, often current pipette technology limits precise volume control to no less than 2 micro liters.

Experiments involving precious fluids (e.g., solutions of antibodies, nucleic acids, enzymes, therapeutics, cell cultures, or samples with a short shelf-life) often involve low working concentrations. Thus, the 2 micro liter lower limit of current pipette technology often involves preparation of serial dilutions to achieve target working concentrations. Serial dilutions are time and resource intensive and are prone to variation and error. By utilizing the print head to control precise volumes distributed from the pipette dispenser, distributed volumes that are substantially below the 2.0 micro liter limit can be achieved (e.g., 0.1 nano liter +/−0.05 nL). Various pipette dispenser and tip combination examples are possible. In some cases, the tip can be manually loaded with a given volume from another collection source and subsequently mated to the pipette dispenser. The pipette dispenser then issues commands that direct the print head to dispense a commanded volume that is less than the collected volume. In another example, a collection nozzle for pipette samples can be integrated with the pipette dispenser. Collected samples from the collection nozzle can then be transferred to a reservoir on the dispenser that can then be distributed via the print head in precise amounts and in response to the commands.

Figure 1:
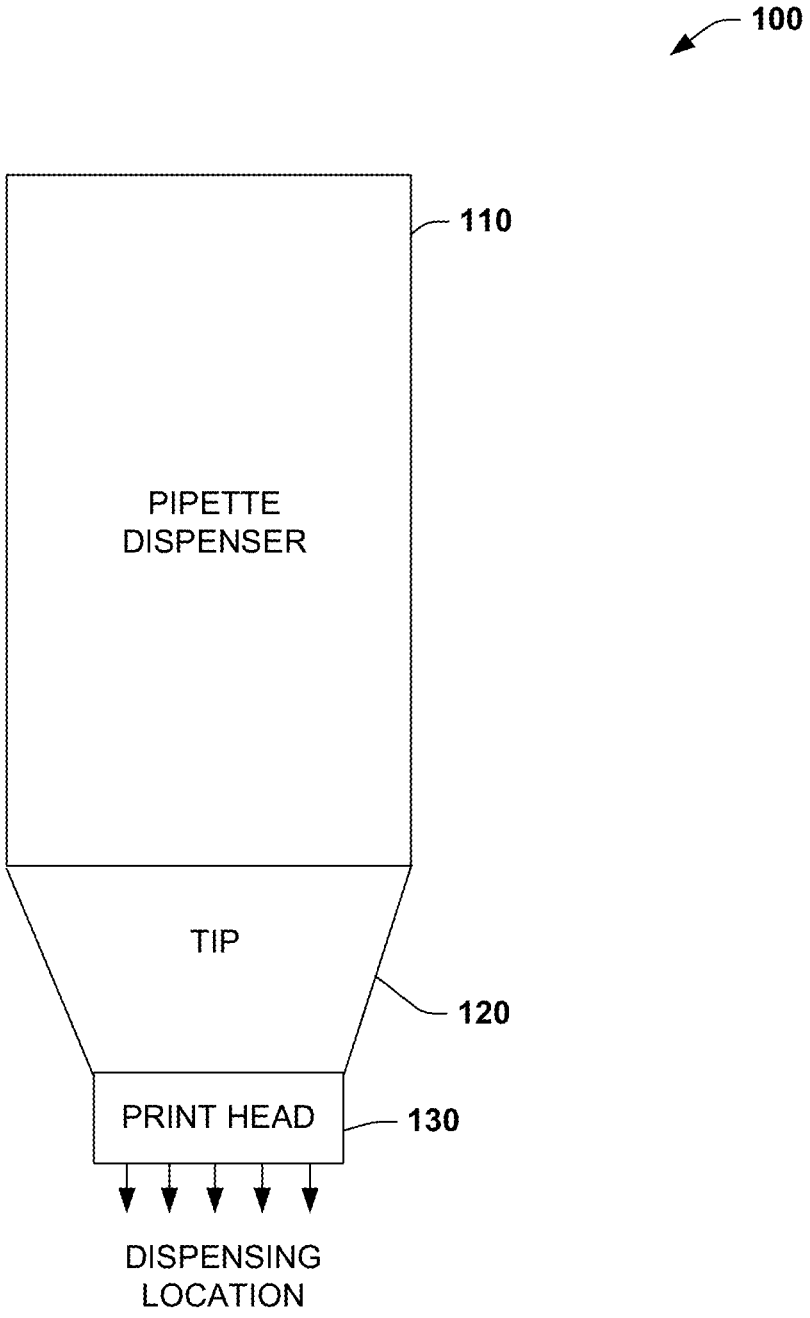
FIG. 1 illustrates an example of an apparatus to control dispensing of a volume from a pipette dispenser utilizing an electromechanical print head.

FIG. 1 illustrates an example of an apparatus 100 to control dispensing of a volume from a pipette dispenser utilizing an electromechanical print head. The apparatus 100 includes a pipette dispenser 110 to control dispensing of a volume to a dispensing location. As used herein, the term volume refers to a liquid solution, dispersant, or fine-grained particulate matter (e.g., solid particles, cells in suspension) that can be dispensed from a given pipette dispenser. A tip 120 is operatively coupled to the pipette dispenser 110, where operatively coupled can include both electrical and mechanical connections between the tip and the dispenser. The tip includes an electromechanical print head 130 to dispense the volume from the pipette dispenser 110 to the dispensing location based on a command from the pipette dispenser that indicates an amount of the volume to be dispensed from the print head. The print head 130 can be substantially any type of print head that dispenses a volume in response to electrical commands.

Example print heads can include thermal ink jet print heads or piezoelectric print heads, for example. The fluid supplied to the tip 120 can be provided as a fluidic cartridge, in one example, that is inserted into the pipette dispenser 110 with the capability of providing suitable volumes described herein to the tip 120 containing the print head 130. The fluidic cartridges can be interchangeable, providing multiple fluids through a given print head 130. The tip 120 may also be interchangeable and autoclaved between fluids. The tip 120 can therefore be used several times for the same or different fluid and then after a pre-determined volume of fluid has passed through the tip 120, then the tip 120 can be replaced, if desired.

In one example, the tip 120 can receive the volume from another collection source (e.g., a collection pipette that collects large volume samples above 2.0 micro liters (e.g., 1.0 milliliters) other than the pipette dispenser 110. After loading, the tip 120 can be mated to the pipette dispenser 110 to dispense the amount of the volume from the print head 130 based on the command (see e.g., FIGS. 2 and 3). In another example, the pipette dispenser 110 can include a collecting tip to collect the volume (see e.g., FIG. 5). The collecting tip transfers the volume to the print head 130 to be dispensed at the dispensing location based on the command.

The print head 130 can be a thermal ink jet print head, for example, that dispenses a specified volume in response to the command but other print head types are possible. The pipette dispenser 110 can include a controller (see e.g., FIGS. 3 and 5) to generate the command to the print head 130 to indicate the amount of the volume to be dispensed from the print head. The controller can include a wireless connection (e.g., Bluetooth) to receive dispensing commands for the print head 130 from a remote computing location. The print head 130 can be employed to control the portion of the volume dispensed from the pipette dispenser 110 and tip 120 based on the command such that the portion is less than a predetermined amount of the volume. For example, the volume collected can be about 1.0 milliliters or more and the dispensed portion from the collected volume can be controlled to a range that is about 2.0 micro liters to about 0.1 nano liters by the print head 130. As will be illustrated and described below with respect to FIG. 5, the pipette dispenser 130 can include a universal serial bus connection to provide power to the pipette dispenser. Other features can include displays that show the amount dispensed from the print head 130. The display can also provide a menu of available dispensing amounts that can be distributed via the print head 130.

Figure 2:
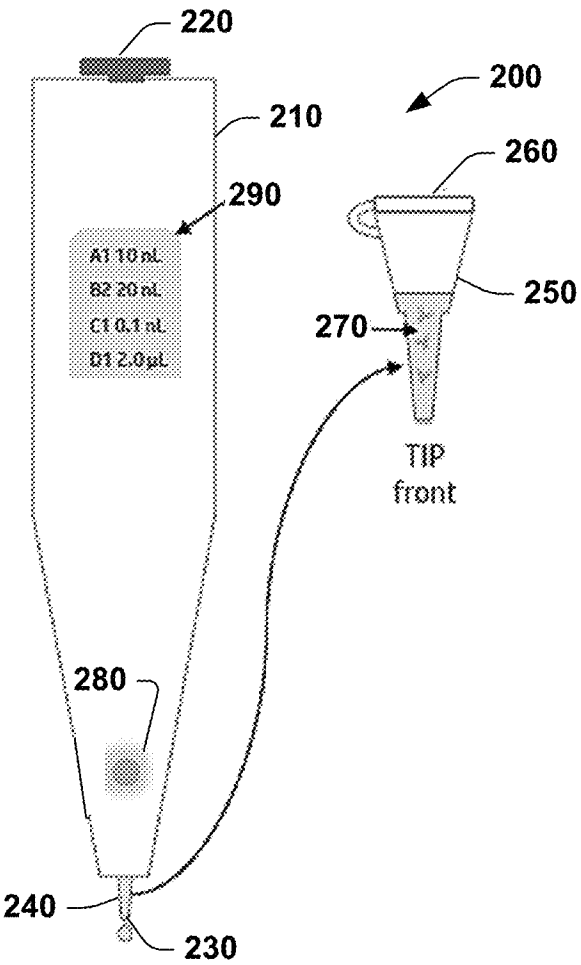
FIG. 2 illustrates an example external view of an apparatus to control dispensing of a volume from a pipette dispenser utilizing a print head.

FIG. 2 illustrates an example external view of an apparatus 200 to control dispensing of a volume from a pipette dispenser 210 utilizing a print head. The pipette dispenser 210 includes a button 220 that enables the user to issue a dispense command issued to a print head 230. The print head 230 can be attached to a tip 240. An expanded view of the tip 240 is shown at 250 that includes a lid 260 that holds a user loaded sample at 270. A firing LED 280 can be provided to indicate when dispensing from the print head 230 is in progress. The pipette dispenser 210 may also include a display 290 that displays example print head dispense and/or take-up/collection values such as 10 nano liters (nL), 20 nL, 0.1 nL, and 2.0 micro liters, for example.

The apparatus 200 can be implemented as a wireless handheld device with sub-micro-liter dispensing control via the print head 230. This includes pre-programmed or user-defined dispensing protocols that can dispense single or complex mixtures. The mixtures can be premixed with diluents or directly injected. A universal serial bus (USB) interface and/or other computer interface can also be provided. The tip 270 can be implemented as 10 or 20 micro liter tips, for example, which can then be dispensed from the print head 230. Applications supported by the apparatus 200 include immunology assay development, molecular biology, molecular diagnostics, cancer research, drug discovery, quality assurance and quality control, and other biotech, biopharma, or life sciences applications, for example.

Figure 3:
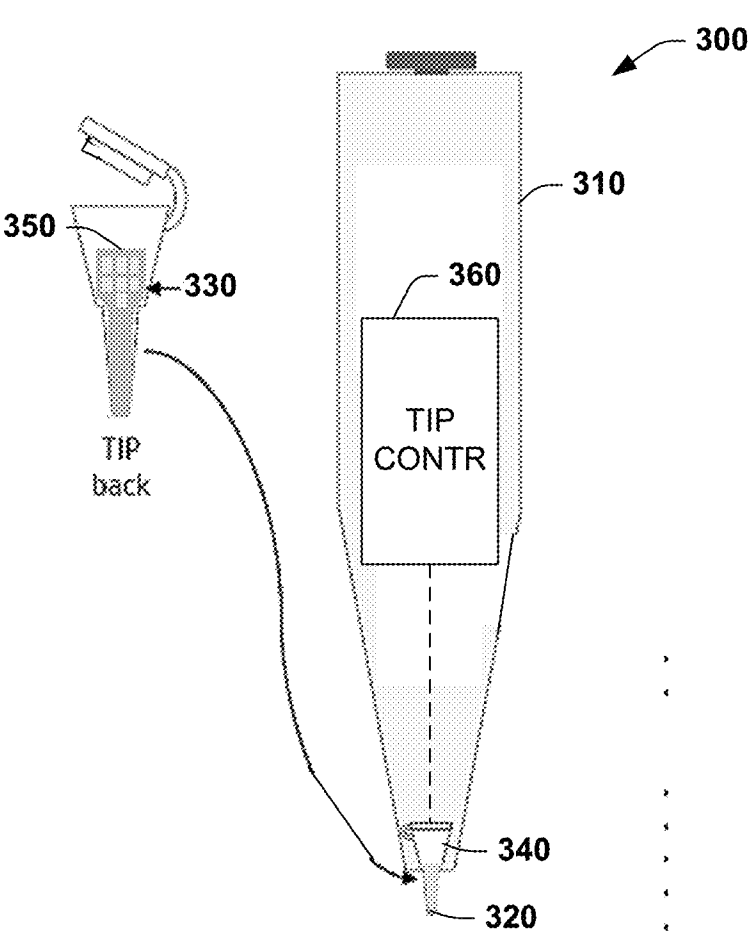
FIG. 3 illustrates an example internal view of an apparatus to control dispensing of a volume from a pipette dispenser utilizing a print head.

FIG. 3 illustrates an example internal view of an apparatus 300 to control dispensing of a volume from a pipette dispenser 310 utilizing a print head 320. In this view, a loadable tip 330 is shown within the dispenser 310 at 340. The tip 330 can include an electrical connection 350 (e.g., wire mesh connection) that interacts with a tip controller 360. The tip controller 360 can include onboard memory for pre-programmed and customizable dispensing applications including system diagnostics. This can include a rechargeable battery which can be mounted inside the pipette dispenser 310 body (see e.g., FIG. 5). The tip controller 360 can include a flex pad interface, a USB interface with computer, an LED indicator light control, and a user interface control. Other example features of the pipette dispenser are illustrated with respect to FIG. 5.

Figure 4:
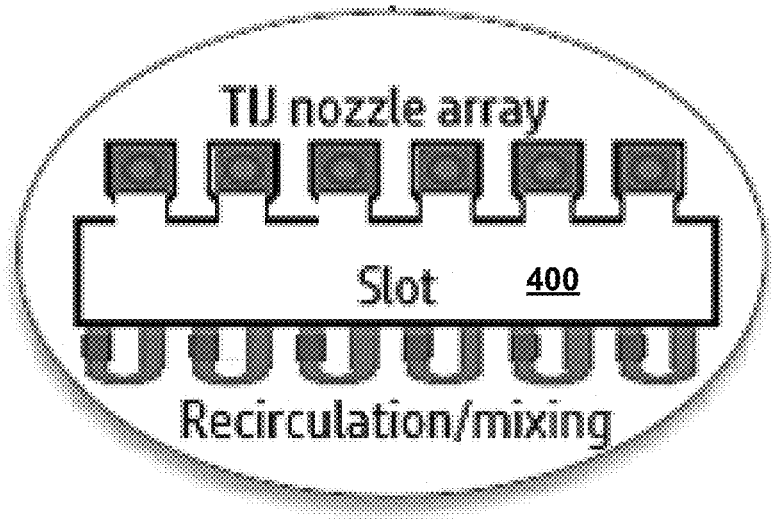
FIG. 4 illustrates an example of a print head that can control dispensing of a volume from a pipette dispenser tip.

FIG. 4 illustrates an example of a print head 400 that can control dispensing of a volume from a pipette dispenser tip. The print head 400 in this example can be a thermal ink jet (TIJ) print head. This may include a TIJ nozzle array along with recirculation and mixing elements. The print head 400 can be implemented as a micro-electromechanical machine (MEMs) device. Thermal inkjet technology uses heat, as opposed to electricity, to force a given volume from the print head 400 to the dispensing location. Similar to the manner water bubbles when boiled, thermal inkjet technology operates by electrifying microscopic resistors behind the print nozzle, creating an intense heat that vaporizes the volume to be dispensed to create a bubble that expands so rapidly the volume literally explodes onto the dispensing location. After ejecting the volume, the chamber then cools quickly to allow more dispersant (e.g., fluid) to refill the chamber and the process can be repeated.

In another example, a piezo print head can be utilized as the print head 400. Piezo print heads include microscopic piezoelectric elements that are constructed behind the print nozzles. When an electrical charge is applied to them, these elements can bend backward, forcing precise amounts of volume onto the dispensing location. Since electrical charges can be turned on and off like a switch, there can be a large amount of control over the rate of dispersant being ejected through the nozzle while also creating spherical dispensing dots at different droplet sizes.

Figure 5:
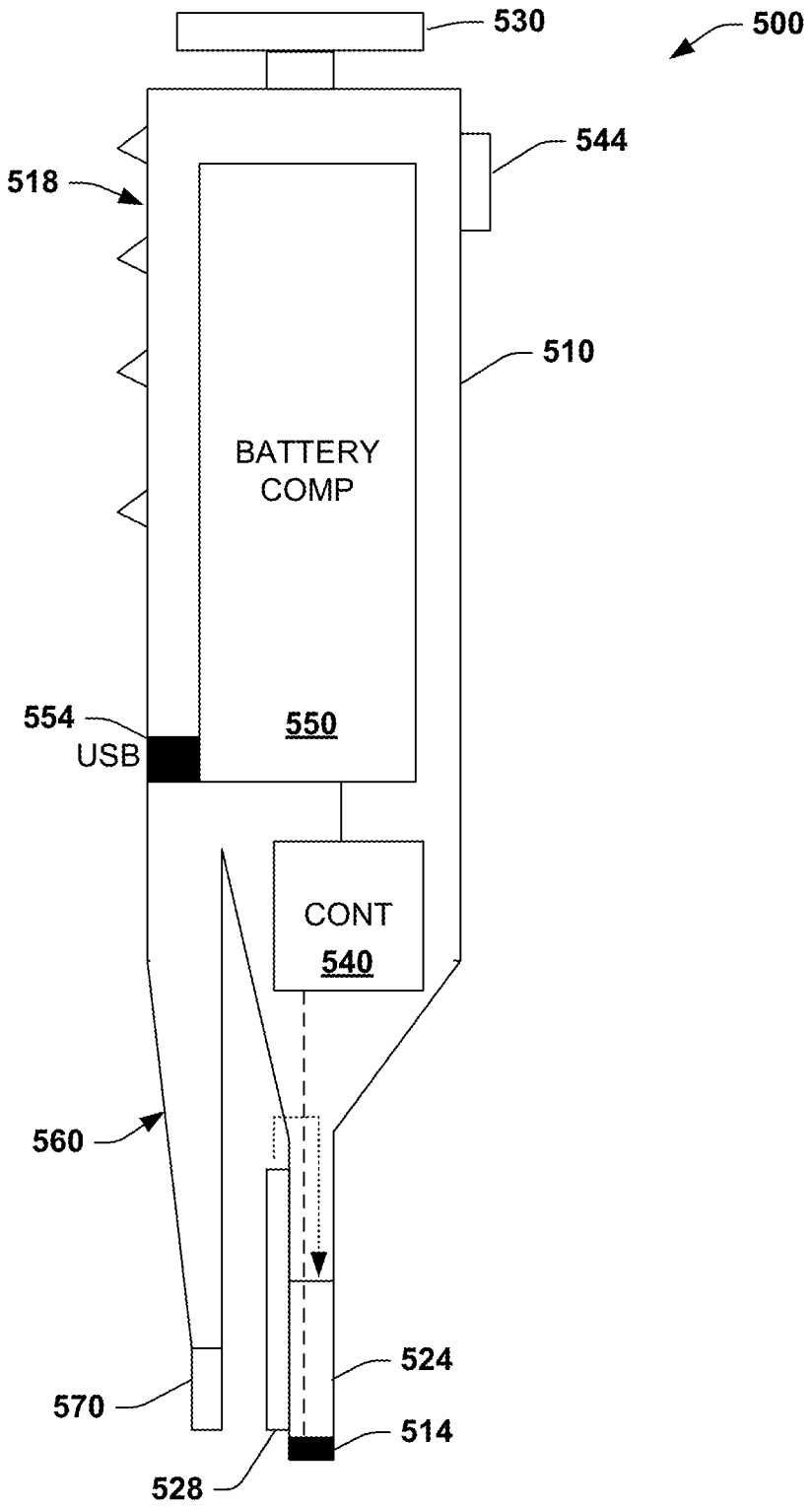
FIG. 5 illustrates an example of a system to control dispensing of a volume from a pipette dispenser utilizing a print head.

FIG. 5 illustrates an example of a system 500 to control dispensing of a volume from a pipette dispenser 510 utilizing a print head 514. In one example, the pipette dispenser 510 body can be approximately 30 centimeter (cm) in length and ergonomically designed for ease of use in either the right or left hand. Example grip locations such as that shown at 518 can be provided. In one example, a disposable 10 to 20 micro liter (μL) vessel or pipette tip into which the user loads at least 2 μL of precious fluid can be provided at 524. Similar to the apparatus previously described, the system 500 can include the pipette dispenser 510 to enable dispensing of a volume to a dispensing location. The tip 524 can be operatively coupled to the pipette dispenser 510 (e.g., via wired connection). The tip 524 includes the print head 514 to dispense a portion of the volume to the dispensing location. The print head 514 can be employed to control the portion of the volume dispensed from the pipette dispenser 510 such that the portion is less than a predetermined amount of the larger collected volume. For example, if the collected volume in the tip 524 is about 2.0 micro liters, the dispensed portion can be controlled when dispensed to a range from about 2.0 micro liters to about 0.1 nano liters or less by the print head 514. To avoid contamination, the collection tip and the dispense head may be on two separate connections, for example.

The tip 524 receives the volume from another collection source than the pipette dispenser in manual load application where the tip 524 can be mated to the pipette dispenser to dispense the amount of the volume from the print head 514 based on the command. In an alternative example, a collecting nozzle 528 can be provided that is emptied into the dispensing vessel at 524. This can include MEMs pumps or other pneumatic devices to create a vacuum to collect samples into the collecting nozzle 528 and then transfer the collected sample into the vessel at 524.

The pipette dispenser 510 can connect to an integrated MEMS chip with thermal ink jet (TIJ) nozzles and associated components as previously described. The body of the dispenser 510 can also connect to an integrated pad flex interface, for example. A plunger or button 530 at the top of the pipette body initiates fluid dispensing or dispenser ejection via mechanical motion initiated by the button. In one example, pushing the button 530 creates electrical signals that can generate a command to the print head 514 to dispense via a controller 540. In another example, pushing the button 530 down far enough mechanically disconnects the pipette tip 524 from the pipette dispenser 510 similar to how a conventional pipette tip is disconnected from a pipette. An optional side push button to command volume ejections can be provided at 544 on the pipette dispenser 510. The controller 540 is resident in the pipette dispenser 510 and actuates nozzle firing on the MEMS chip for control of the print head 514 via the flex interface described herein.

A double ejection mechanism can be provided that includes partial actuation that ejects only fluid and full actuation that ejects the tip from the pipette body. Onboard memory (not shown) can be provided for pre-programmed or user-defined protocols, customizable applications, and system diagnostics, for example. An onboard rechargeable battery 550 can be provided for wireless functioning. Battery recharging can be provided via USB interface 554. A low voltage warning/lockout can occur when the battery 550 is low (e.g., below a predetermined threshold). A USB to computer or thumb drive interface can be provided to enable data transfer and application sharing, for example. A Bluetooth wireless connection (not shown) can be provided for communications to the controller 540. A digital user interface can be provided to select protocols or to manually define fluid volumes on-the-fly. The interface can prompt users to move through protocol steps for dispensing a given volume, for example. An onboard LED (See e.g., FIG. 2) indicates ejection cycle status, low fluid volume, and suitable pipette body flex to controller electrical connection status. The pipette dispenser 510 housing can be sterilized by wiping with standard antimicrobial solutions (e.g., 70% ethanol).

The tips 524 can have well-plate alignment mechanism for direct dispensing that should not contaminate the body TIJ head 514. This may involve a crutch or guide that matches up with common plate formats (e.g., 96, 48, or lower density well plates) or other reaction vessels. A pipette stand (not shown) can be provided that holds the pipette dispenser 510 in a fixed position with a moveable stage below where a micro-well plate or other reaction vessel may be moved into position. The pipette dispenser 510 can include user feedback to confirm correct placement before dispensing. This can also serve as docking station for computer interface and battery recharging, for example. Also, volume ejection feedback loop can be provided which reports actual fluid volume ejected for QA/QC and diagnostics. Such status can be provided via a display which can be mounted at display location 560. Other mechanisms can be provided to aspirate in precious fluids and/or diluent for streamlined use. Pipette dispenser housings may be modular to allow critical component sterilization by autoclave, for example. This may include backpressure regulation via pump or valve at the dispenser 510.

The controller 540 can include a processor that can execute instructions from a memory not shown. The processor can be a central processing unit (CPU), field programmable gate array (FPGA), or a set of logic blocks that can be defined via a hardware description language such as VHDL. The instructions can be executed out of firmware, random access memory, and/or executed as configured logic blocks, such as via registers and state machines configured in a programmable gate array, for example. The instructions can be stored on a machine-readable medium such as a memory, for example. Although a display at 560 is shown, other user feedback features can be activated such as audio instructions indicating when to dispense at a given location. As noted previously, display of potential dispensing values that can be dispensed via the print head 514 can be displayed. These values can be displayed in increments such as in a range that is less than 2.0 micro liters for example down to smaller dispensing amounts such as 0.1 micro liter, for example.

The display 560 can be located below the hand grip area such as shown at 518 to enable ambidextrous operation of the pipette dispenser 510. An optional dispense button 570 can be provided on the end of the pipette dispenser 510 to enable automatic dispensing when the pipette dispenser has achieved a desired dispensing depth with respect to a given dispensing location. The pipette dispenser 510 can be constructed out of various materials including plastic (e.g., Lexan) body construction. Metallic body construction can also be provided. Hybrid construction can include both metallic and plastic components that form the overall body construction.

What have been described above are examples. One of ordinary skill in the art will recognize that many further combinations and permutations are possible. Accordingly, this disclosure is intended to embrace all such alterations, modifications, and variations that fall within the scope of this application, including the appended claims. Additionally, where the disclosure or claims recite "a," "an," "a first," or "another" element, or the equivalent thereof, it should be interpreted to include one or more than one such element, neither requiring nor excluding two or more such elements. As used herein, the term "includes" means includes but not limited to, and the term "including" means including but not limited to. The term "based on" means based at least in part on.

What is claimed is:

1. An apparatus, comprising:

a pipette dispenser to control dispensing of a volume to a dispensing location;

a dispensing tip that is operatively coupled to the pipette dispenser, the dispensing tip includes an electromechanical print head including a nozzle array to dispense the volume from the pipette dispenser to the dispensing location based on a command from the pipette dispenser that indicates an amount of the volume to be dispensed from the print head; and a collecting nozzle coupled to the pipette dispenser to collect the volume to be dispensed, the collecting nozzle to transfer the volume to the print head of the dispensing tip, wherein the collecting nozzle is aligned parallel to and integrated with the dispensing tip and positioned adjacent the print head, wherein the collecting nozzle is integrated with the pipette dispenser and includes a pneumatic device to create a vacuum and collect the volume into the collecting nozzle and transfer the volume into the dispensing tip.

2. The apparatus of claim 1, wherein the print head is at least one of a thermal ink jet print head and a piezo print head that dispenses a specified volume in response to the command.

3. The apparatus of claim 1, wherein the pipette dispenser includes a controller to generate the command to the print head to indicate the amount of the volume to be dispensed from the print head.

4. The apparatus of claim 3, wherein the controller includes a wireless connection to receive dispensing commands for the print head from a remote computing location.

5. The apparatus of claim 1, wherein the pipette dispenser includes a controller to generate the command to control the amount of the volume to be dispensed from the print head to be less than a collected volume collected by the collecting tip.

6. The apparatus of claim 5, wherein the collected volume is about 1.0 milliliters and the amount of the volume to be dispensed is controlled to be in a range from about 2.0 micro liters to about 0.1 nano liters by the print head.

7. The apparatus of claim 1, wherein the pipette dispenser further comprising a universal serial bus connection to provide power to the pipette dispenser.

8. The apparatus of claim 1, wherein the print head is a micro-electromechanical machine (MEMs) device.

9. The apparatus of claim 3, wherein the dispensing tip includes an electrical connection that interacts with the controller to receive the command.

10. The apparatus of claim 1, wherein the print head includes a piezo print head including piezo elements proximal to the nozzle array, and in response to the command, an electric charge is applied to the piezo elements and the piezo elements bend and force the amount of the volume to dispense from the pipette dispenser.

11. An apparatus, comprising:

a pipette dispenser to dispense a volume to a dispensing location;

a dispensing tip that is operatively coupled to the pipette dispenser, the dispensing tip includes an electromechanical print head including a nozzle array to dispense a portion of the volume to the dispensing location, the print head configured to control the portion of the volume dispensed from the pipette dispenser to be less than a collected volume; and a collecting nozzle coupled to the pipette dispenser to collect the collected volume, the collecting nozzle to transfer the collected volume to the dispensing tip, wherein the collecting nozzle is aligned parallel to and integrated with the dispensing tip and positioned adjacent the print head, wherein the collecting nozzle is integrated with the pipette dispenser and includes a pneumatic device to create a vacuum and collect the volume into the collecting nozzle and transfer the volume into the dispensing tip.

12. The apparatus of claim 11, wherein the collected volume is about 1.0 milliliters and the portion is controlled to be in a range from about 2.0 micro liters to about 0.1 nano liters by the print head.

13. The apparatus of claim 11, wherein the print head is a micro-electromechanical machine (MEMs) device and thermal inkjet (TIJ) nozzles forming the nozzle array.

14. The apparatus of claim 13, wherein the pipette dispenser includes a controller coupled to the print head to generate and provide a command to the print head to indicate the portion of the volume to dispense from the print head, and in response to the command, the TIJ nozzles are to create a bubble in the volume and cause the portion of the volume to dispense from the pipette dispenser.

15. The apparatus of claim 11, further including a controller in the pipette dispenser to specify a command based the portion of the volume to be dispensed to the dispensing location, the controller coupled to the print head to provide the command, and in response, to cause the nozzle array to dispense the portion of the volume to the dispensing location.

16. A system, comprising:

a pipette dispenser to control dispensing of a volume to a dispensing location;

a controller in the pipette dispenser to specify a command based on an amount of the volume to be dispensed to the dispensing location;

a dispensing tip that is operatively coupled to the pipette dispenser, the dispensing tip includes an electromechanical print head including a nozzle array to dispense the volume to the dispensing location based on the command from the controller that indicates an amount of the volume to be dispensed from the print head; and a collecting nozzle coupled to the pipette dispenser to collect a collected volume, the collecting nozzle to transfer the collected volume to the dispensing tip for dispensing by the print head, wherein the collecting nozzle is aligned parallel to and integrated with the dispensing tip and positioned adjacent the print head, wherein the collecting nozzle is integrated with the pipette dispenser and includes a pneumatic device to create a vacuum and collect the volume into the collecting nozzle and transfer the volume into the dispensing tip.

17. The system of claim 16, wherein the print head is to control the portion of the volume dispensed from the pipette dispenser based on the command to be less than the collected volume, wherein the collected volume is about 1.0 milliliters and the portion is restricted to be in a range from about 2.0 micro liters to about 0.1 nano liters by the print head.

18. The system of claim 16, wherein the controller is coupled to the print head via an electrical connection to provide the command to the print head to indicate the amount of the volume to be dispensed from the print head, and in response to the command, the nozzle array is to dispense the amount of the volume from the pipette dispenser.

* * * * *